US008926033B2

(12) United States Patent
Chen et al.

(10) Patent No.: US 8,926,033 B2
(45) Date of Patent: Jan. 6, 2015

(54) DOOR CLOSURE STRUCTURE FOR ROTARY DOOR AND SIDE-BY-SIDE REFRIGERATOR COMPRISING THE SAME

(75) Inventors: Hao Chen, Hefei (CN); Jun Yao, Hefei (CN)

(73) Assignees: Hefei Midea Refrigerator Co., Ltd., Hefei (CN); Hefei Hualing Co., Ltd., Hefei (CN)

( * ) Notice: Subject to any disclaimer, the term of this patent is extended or adjusted under 35 U.S.C. 154(b) by 0 days.

(21) Appl. No.: 14/006,284

(22) PCT Filed: May 23, 2011

(86) PCT No.: PCT/CN2011/074540

§ 371 (c)(1), (2), (4) Date: Sep. 19, 2013

(87) PCT Pub. No.: WO2012/159260

PCT Pub. Date: Nov. 29, 2012

(65) Prior Publication Data

US 2014/0009056 A1 Jan. 9, 2014

(51) Int. Cl.

| | |
|---|---|
| ***A47B 96/04*** | (2006.01) |
| ***E06B 3/36*** | (2006.01) |
| ***E05C 19/04*** | (2006.01) |
| ***E05D 11/10*** | (2006.01) |
| ***F25D 23/02*** | (2006.01) |
| *E05B 65/00* | (2006.01) |

(52) U.S. Cl.

CPC . *E06B 3/36* (2013.01); *E05C 19/04* (2013.01); *E05D 11/1078* (2013.01); *F25D 23/028* (2013.01); *E05B 65/0042* (2013.01); *E05Y 2900/31* (2013.01); *F25D 2323/024* (2013.01)

USPC ..... 312/405; 312/324

(58) Field of Classification Search

CPC ..... F25D 23/028; F25D 2323/024; F25D 2323/021; E05Y 2900/31

USPC ..... 312/405, 326–329; 62/449; 49/399

See application file for complete search history.

(56) References Cited

U.S. PATENT DOCUMENTS 3,259,936 A * 7/1966 Sheridan ..... 16/49
5,579,606 A * 12/1996 Kim ..... 49/386

(Continued)

FOREIGN PATENT DOCUMENTS

CN 2116182 9/1992
CN 101949629 1/2011

(Continued)

*Primary Examiner* — Hanh V Tran
(74) *Attorney, Agent, or Firm* — Hodgson Russ LLP

(57) ABSTRACT

A door closure structure for a rotary door and a side-by-side refrigerator comprising the same are provided. The rotary door is rotatably mounted on a main body. The door closure structure comprises: a hinge assembly comprising a hinge body, a hinge plate and a hinge shaft, via which the rotary door is mounted on the main body; a supporting plate extended in a lateral direction, provided with a first hole and connected with a front end of the hinge body; a mask body fixed on the rotary door, in which a mask cavity is defined and in a surface of which a second hole is disposed; and an engaging block retractably and movably disposed in the mask cavity. A part of the engaging block is exposable out of the mask body from the second hole and engagable with the first hole to make the rotary door close the main body.

17 Claims, 5 Drawing Sheets

(56) References Cited

U.S. PATENT DOCUMENTS

| | | | | |
|---|---|---|---|---|
| 5,975,663 | A * | 11/1999 | Becker | 312/405 |
| 6,883,841 | B2 * | 4/2005 | Kawabata et al. | 292/336.3 |
| 2005/0188506 | A1 | 9/2005 | Lee et al. | |
| 2006/0232176 | A1 * | 10/2006 | Kim et al. | 312/405 |
| 2006/0238091 | A1 * | 10/2006 | Linke et al. | 312/405 |
| 2008/0116777 | A1 * | 5/2008 | Kappler et al. | 312/404 |
| 2008/0168618 | A1 * | 7/2008 | Hottmann | 16/50 |
| 2008/0284179 | A1 * | 11/2008 | Gerner et al. | 292/13 |
| 2009/0056072 | A1 * | 3/2009 | McKinney et al. | 16/63 |
| 2009/0064457 | A1 * | 3/2009 | Brustle | 16/292 |
| 2010/0109497 | A1 * | 5/2010 | Blersch et al. | 312/405 |

FOREIGN PATENT DOCUMENTS

| | | |
|---|---|---|
| CN | 102226366 | 10/2011 |
| JP | 10160332 | 6/1998 |
| JP | 11257837 | 9/1999 |

* cited by examiner

DOOR CLOSURE STRUCTURE FOR ROTARY DOOR AND SIDE-BY-SIDE REFRIGERATOR COMPRISING THE SAME

FIELD

The present disclosure relates to a refrigeration equipment field, and more particularly relates to a door closure structure for a rotary door and a side-by-side refrigerator comprising the same.

BACKGROUND

A conventional side-by-side refrigerator usually has a large refrigerating chamber space, which is convenient to use. However, as a swing turnover beam is disposed between two doors of the side-by-side refrigerator in order to provide a better sealing effect for the refrigerating chamber, one door of the refrigerator is liable to be opened due to a pressure caused when the other door is closed with a large force. Due to a bad door closure stopping effect, the door of the refrigerator is usually not closed tightly, which makes the refrigerator leak cold and a condensation power consumption increase.

SUMMARY

The present disclosure aims to solve at least one of the problems in the prior art.

For this, one objective of the present disclosure is to provide a door closure structure for a rotary door which has a better door closure stopping effect.

Another objective of the present disclosure is to provide a side-by-side refrigerator comprising the above door closure structure.

According to embodiments of a first aspect of the present disclosure, a door closure structure for a rotary door is provided. The rotary door is rotatably mounted on a main body. The door closure structure comprises: a hinge assembly, in which the rotary door is mounted on the main body via the hinge assembly, and the hinge assembly comprises: a hinge body fixed on the main body in a longitudinal direction; a hinge plate provided with a hinge hole and connected with a rear end of the hinge body; and a hinge shaft fitted with the hinge hole; a supporting plate extended in a lateral direction, provided with a first hole and connected with a front end of the hinge body; a mask body fixed on the rotary door, in which a mask cavity is defined in the mask body and a second hole is disposed in a surface of the mask body; and an engaging block retractably and movably disposed in the mask cavity, in which a part of the engaging block is exposable out of the mask body from the second hole and the part of the engaging block extended out of the mask body is engagable with the first hole to make the rotary door close the main body.

The door closure structure according to embodiments of the present disclosure has a good door closure stopping effect, and the door is not easy to open when acted on by an external interference force. Furthermore, the door closure structure according to embodiments of the present disclosure has a simple structure and a low cost. Moreover, the user feels comfortable when opening or closing a door with the door closure structure according to embodiments of the present disclosure.

In addition, the door closure structure for the rotary door according to embodiments of the present disclosure may also have the following additional technical features.

A first surface of the mask body is open, and a hollow column with a cylindrical hole defined therein is disposed in the mask cavity and is extended towards the first surface of the mask body from an inner wall of the mask cavity opposite to the first surface of the mask body. The door closure structure further comprises: a cover plate disposed on the first surface of the mask body to close the first surface, in which the second hole is formed in the cover plate; and an elastic member, in which the elastic member is abutted between the hollow column and the engaging block after being pre-compressed.

A groove communicated with the first surface is formed in a second surface of the mask body adjacent to the first surface of the mask body, in which the supporting plate is adapted to be inserted from the groove for fitting the first hole with the engaging block.

Alternatively, the first surface of the mask body is a lower surface of the mask body and the second surface of the mask body is a left surface of the mask body.

In some embodiments, the engaging block is spherical.

In other embodiments, the engaging block is polyhedral.

Alternatively, the first hole and the second hole are round holes.

Alternatively, the elastic member is a spring or a bellow.

According to embodiments of a second aspect of the present disclosure, a side-by-side refrigerator is provided. The side-by-side refrigerator comprises: two door closure structures according to embodiments of the first aspect of the present disclosure; a main body with an open front surface, in which the hinge bodies of the two door closure structures are disposed on a left side and a right side of a front edge of the main body respectively; and a left door and a right door rotatably mounted on the front surface of the main body, in which the mask bodies of the two door closure structures are mounted on horizontal end surfaces of the left door and the right door respectively.

Alternatively, the mask bodies are mounted on upper end surfaces of the left door and the right door respectively.

With the side-by-side refrigerator according to embodiments of the present disclosure, by using the above door closure structure, a better door closure stopping effect is obtained, and one door is not opened due to a pressure caused when the other door is closed with a large force, which prevents the refrigerator from leaking cold and reduces the condensation power consumption.

Additional aspects and advantages of the embodiments of the present disclosure will be given in part in the following descriptions, become apparent in part from the following descriptions, or be learned from the practice of the embodiments of the present disclosure.

BRIEF DESCRIPTION OF THE DRAWINGS

These and other aspects and advantages of the disclosure will become apparent and more readily appreciated from the following descriptions taken in conjunction with the drawings in which.

DETAILED DESCRIPTION

Figure 1:
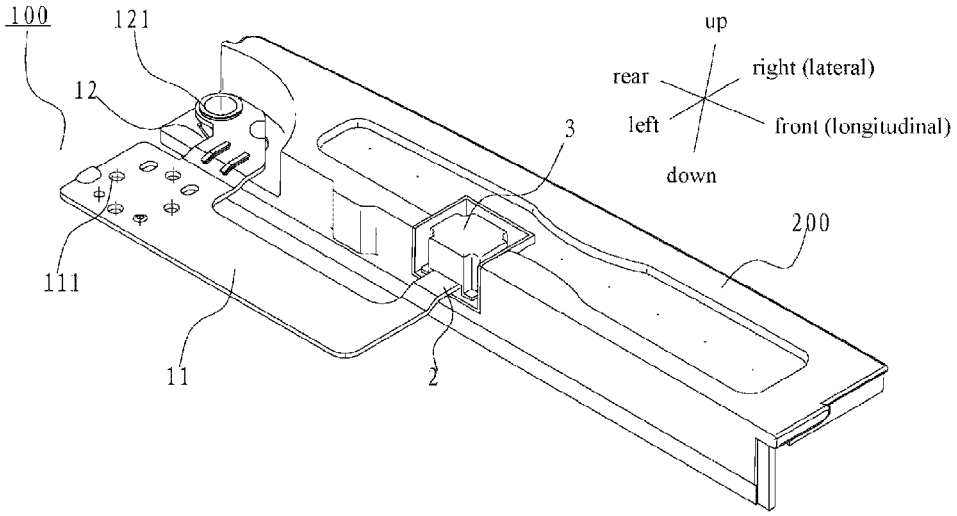
FIG. 1 is a schematic view of a door closure structure for a rotary door during a process of closing the rotary door according to an embodiment of the present disclosure.

Embodiments of the present disclosure will be described in detail in the following descriptions, examples of which are shown in the accompanying drawings, in which the same or similar elements and elements having same or similar functions are denoted by like reference numerals throughout the descriptions. The embodiments described herein with reference to the accompanying drawings are explanatory and illustrative, which are used to generally understand the present disclosure. The embodiments shall not be construed to limit the present disclosure.

It is to be understood that phraseology and terminology used herein with reference to device or element orientation (such as, terms like "longitudinal", "lateral", "up", "down", "front", "rear", "left", "right", "vertical", "horizontal", "top", "bottom", "inside", "outside") are only used to simplify description of the present invention, and do not indicate or imply that the device or element referred to must have or operated in a particular orientation. They cannot be seen as limits to the present disclosure.

Unless otherwise stipulated and restricted, it is to be explained that terms of "installation", "linkage" and "connection" shall be understood broadly, for example, it could be permanent connection, removable connection or integral connection; it could be direct linkage, indirect linkage or inside linkage within two elements. Those skilled in the art shall understand the concrete notations of the terms mentioned above according to specific circumstances.

In the following, a door closure structure 100 for a rotary door according to embodiments of a first aspect of the present disclosure will be described with reference to FIGS. 1-8. Hereinafter, for the purpose of simplifying the description, the door closure structure 100 is used in a refrigerator as an example, and the door closure structure 100 is used between a door 200 and a main body 400 of the refrigerator (see, e.g., FIG. 8).

Figure 2:
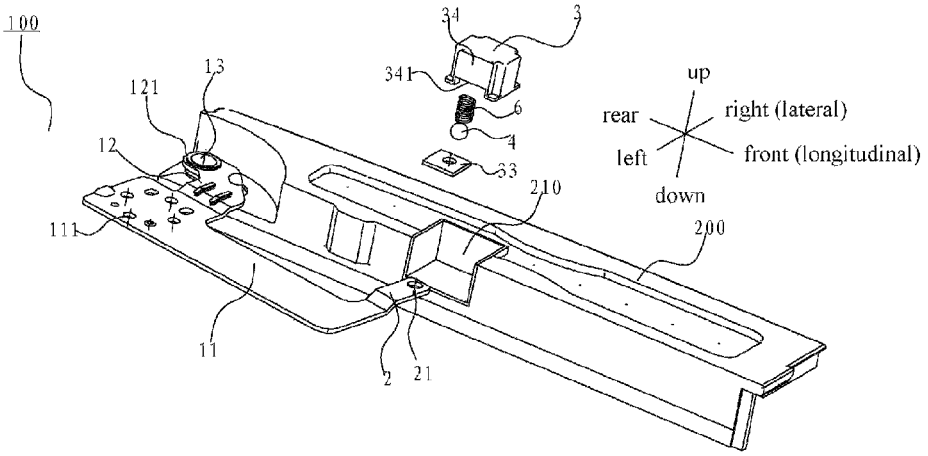
FIG. 2 is an exploded view of the door closure structure shown in FIG. 1.

As shown in FIGS. 1 and 2, the door closure structure 100 according to an embodiment of the present disclosure comprises a hinge assembly 1, a supporting plate 2 extended in a lateral direction, a mask body 3 and an engaging block 4. The door 200 is rotatably mounted on the main body via the hinge assembly 1. In the description of the present disclosure, the mask body 3 is square as an example. Certainly, the mask body 3 may also be polyhedral.

The hinge assembly comprises a hinge body 11, a hinge plate 12 and a hinge shaft 13. As shown in FIG. 2, the hinge body 11 is fixed on the main body in a longitudinal direction. For example, the hinge body 11 is bolted to the main body via a screw hole disposed in the hinge body 11. The hinge plate 12 is provided with a hinge hole 121 and connected to a rear end of the hinge body 11, and the hinge shaft 13 is fitted with the hinge hole 121 to make the door 200 rotatable relative to the main body.

The supporting plate 2 is connected to a front end of the hinge body 11, and a first hole 21 is disposed in the supporting plate 2. The mask body 3 is fixed on the door 200. Specifically, as shown in FIGS. 1 and 2, a mounting recess 210 is formed in the door 200, and the mask body 3 is disposed in the mounting recess 210. A mask cavity is defined in the mask body 3. The engaging block 4 is retractably and movably disposed in the mask cavity and a part of the engaging block 4 is exposable out of the mask body 3 from a second hole 31 in a surface of the mask body 3. The part of the engaging block 4 extended out of the mask body 3 is engagable with the first hole 21 to make the door 200 close the main body.

As shown in FIGS. 1 and 2, when the door 200 is closed to a certain position, the supporting plate 2 connected with the hinge body 11 is extended into the mounting recess 210. At this time, the engaging block 4 is pressed by the supporting plate 2 to retract back into the mask body 3 from the second hole 31. When the supporting plate 2 is extended to a position where the position of the first hole 21 corresponds to the position of the engaging block 4, i.e., when the door 200 is closed, the engaging block 4 is extended out of the mask body 3 from the second hole 31 and engaged with the first hole 21. Thus, a door closure stopping of the door 200 is obtained, which makes the door close tightly and prevents the door 200 from being opened when disturbed by an external force.

The door closure structure according to embodiments of the present disclosure has a good door closure stopping effect, and the door is not easy to open when acted on by an external interference force. Furthermore, the door closure structure according to embodiments of the present disclosure has a simple structure and a low cost. Moreover, the user feels comfortable when opening or closing a door with the door closure structure according to embodiments of the present disclosure.

Figure 3:
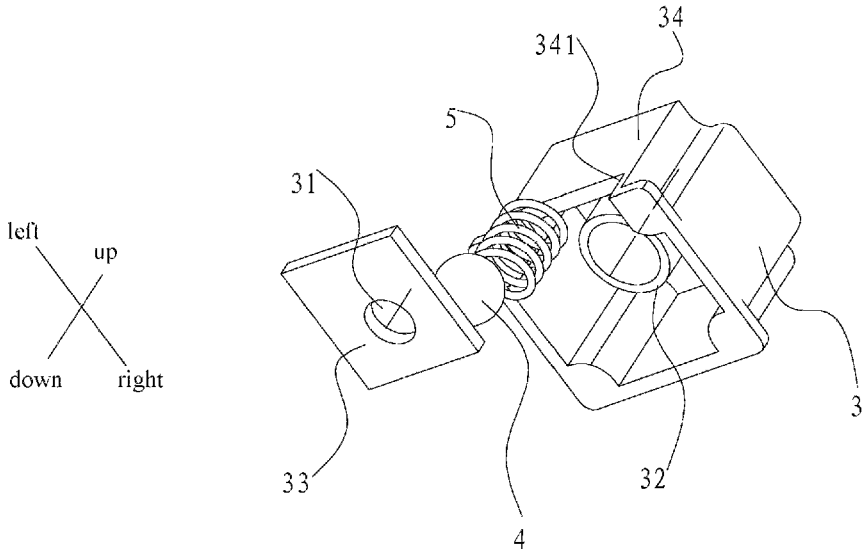
FIG. 3 is an exploded view showing a mask body, an engaging block, and an elastic member of the door closure structure shown in FIG. 1.
Figure 4:
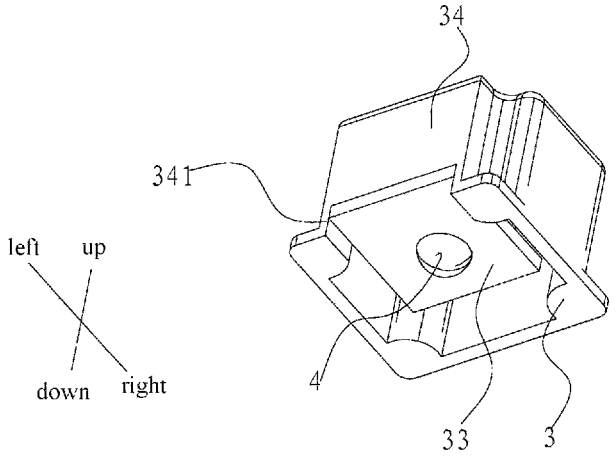
FIG. 4 is a schematic view showing an assembly of the mask body, the engaging block and the elastic member in FIG. 3.
Figure 5:
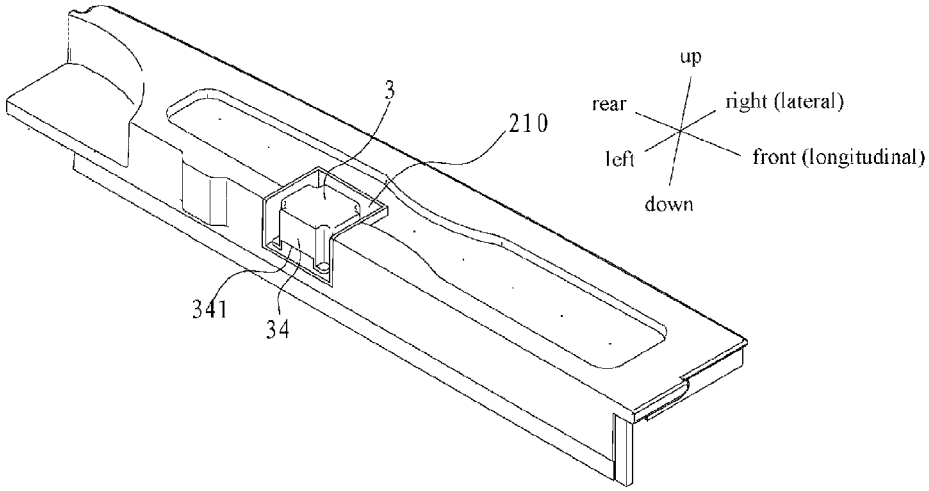
FIG. 5 is a schematic view showing the mask body shown in FIG. 4 mounted on the rotary door.
Figure 6:
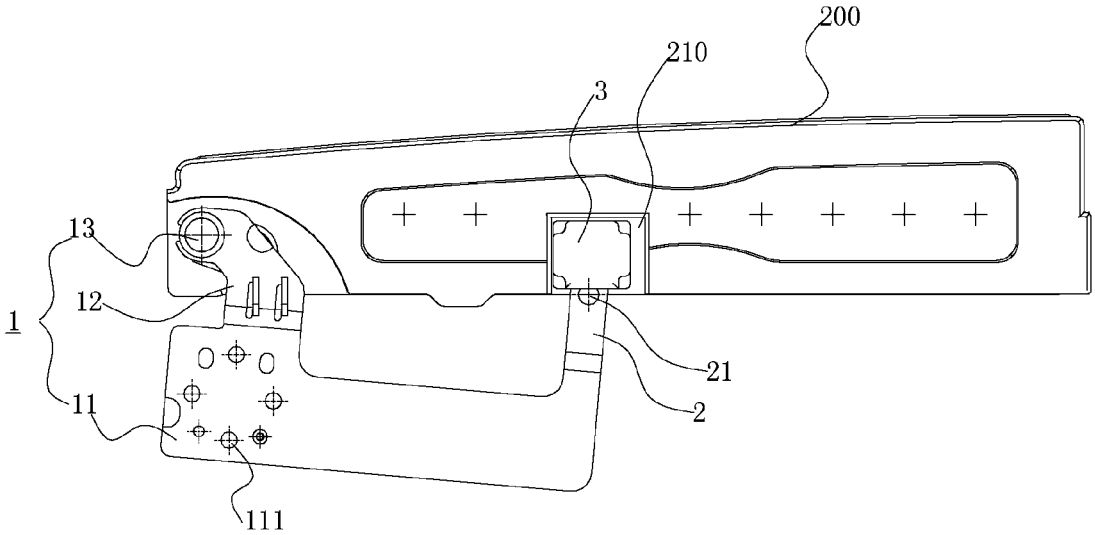
FIG. 6 is a top view of the door closure structure shown in FIG. 1 during the process of closing the rotary door.
Figure 7:
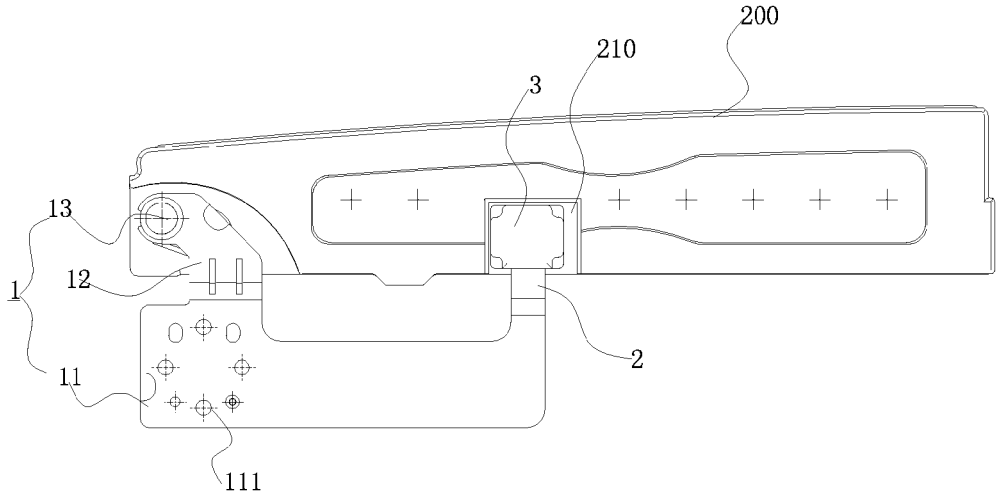
FIG. 7 is a top view of the door closure structure shown in FIG. 1 in a door closure state.
Figure 8:
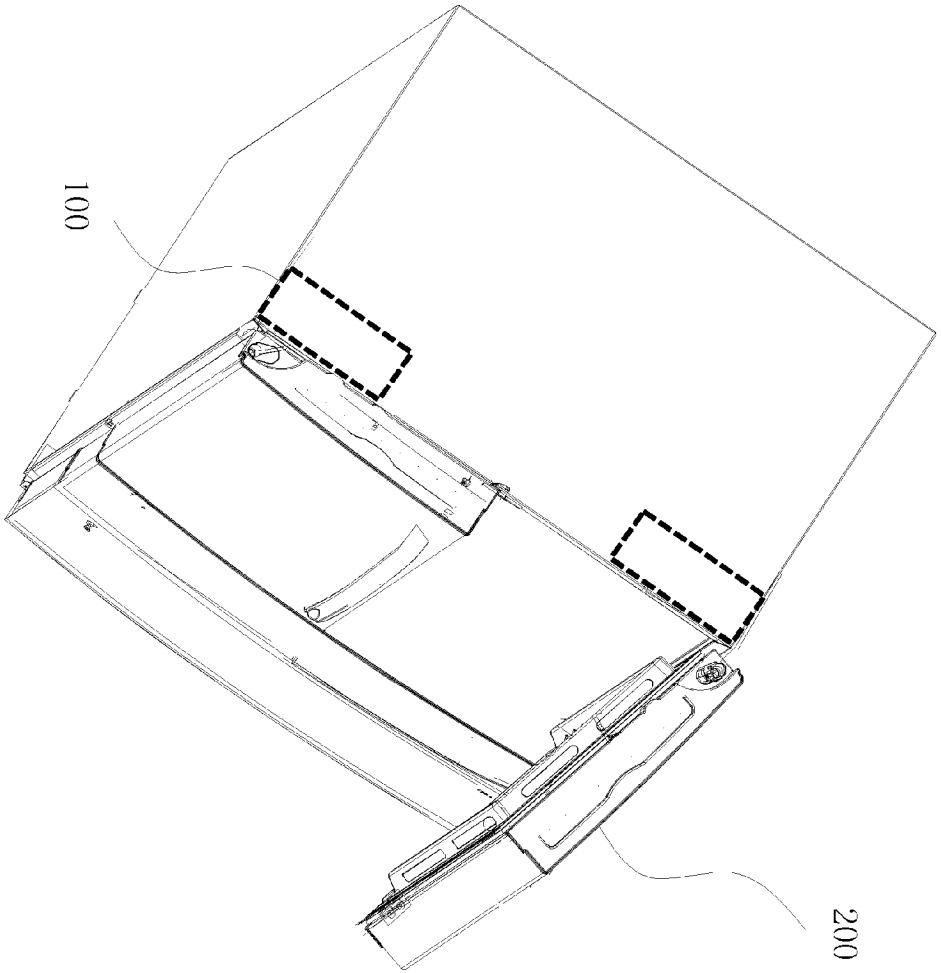
FIG. 8 is a schematic representation of a refrigerator showing the door closure structure according to an embodiment of the present disclosure.

In one embodiment of the present disclosure, as shown in FIGS. 3 and 4, a first surface of the mask body 3 is open, and a hollow column 32 with a cylindrical hole defined therein is disposed in the mask cavity. The hollow column 32 is extended towards the first surface (i.e. the open surface) of the mask body 3 from an inner wall of the mask cavity opposite to the first surface of the mask body 3. At this time, the door closure structure 100 further comprises a cover plate 33 and an elastic member 5. The cover plate 33 is disposed on the first surface of the mask body 3 to close the open first surface, and the second hole 31 is formed in the cover plate 33. The elastic member 5 is abutted between the hollow column 32 and the engaging block 4 after being pre-compressed. Alternatively, the elastic member 5 is a spring or a bellow. In the description of the present disclosure, the elastic member 5 is a spring as an example.

In further embodiments of the present disclosure, a groove 341 communicated with the first surface is formed in a second surface 34 of the mask body 3 adjacent to the first surface of the mask body 3, and the supporting plate 2 is adapted to be inserted from the groove 341 for fitting the first hole 21 with the engaging block 4. In other words, the cover plate 33 is disposed parallel with the first surface and one side of the cover plate 33 is engaged in the groove 341. Thus, a space for housing the supporting plate 2 is formed between the cover plate 33 and a side wall of the recess 210 of the door 200, and the supporting plate 2 is inserted into this space.

During a process of closing the door 200, when the supporting plate 2 is just contacted with the engaging block 4, a certain resistance is produced. When a user closes the door with a small force, the engaging block 4 is pressed by the supporting plate 2 to retract back into the mask body 3 from the second hole 31, and then the spring 5 is pressed to retract. At this time, the spring 5 is acted on by a greater pressure. When the door 200 is closed to a certain degree, the position of the first hole 21 of the supporting plate 2 is just corresponding to the position of the engaging block 4. At the same time, under the action of the spring force of the spring 5, the engaging block 4 is extended out quickly to engage with the first hole 21 of the supporting plate 2. Thus, the door 200 is locked.

In some examples of the present disclosure, the first surface of the mask body 3 is a lower surface of the mask body 3, and the second surface 34 is a left surface of the mask body 3. Thus, as shown in FIGS. 1-5, the hollow column 32 is extended downwards from an upper inner wall of the mask cavity. The spring 5 is disposed between the upper inner wall of the mask body 3 inside the hollow column 32 and the engaging block 4 after pre-compressed and moves up and down, so as to make the engaging block 4 move up and down. Moreover, the space for holding the supporting plate 2 is defined by the cover plate 33 and the bottom wall of the recess 210, i.e., the supporting plate 2 is insert into the space from the bottom of the left side of the mask body 3.

Certainly, the present disclosure is not limited to this. In other examples of the present disclosure, the spring 5 may also move in a left-right direction. At this time, the first surface may be the left surface or the right surface of the mask body 3, and the cover plate 33 may be disposed on the left side or the right side (not shown) of the mask body 3. Thus, the supporting plate 2 may be inserted into the receiving space defined by the recess 210 and the cover plate 33 from the left side or the right side of the mask body 3 to make the engaging block 4 fit with the first hole 21.

In some embodiments of the present disclosure, the engaging block 4 may be spherical. In other embodiments of the present disclosure, the engaging block 4 may be polyhedral. Certainly, the engaging block 4 may also be a column whose length is consistent with the moving direction of the spring 5. Alternatively, the first hole 21 and the second hole 31 are round holes.

In the following, a working process of closing or opening the door of the refrigerator according to an embodiment of the present disclosure is described with reference to FIGS. 1-7.

Firstly, during the process of closing the door, the supporting plate 2 is inserted into the receiving space defined by the recess 210 and the cover plate 33 from the bottom of the left side of the mask body 3, and when the supporting plate 2 is just contacted with the engaging block 4, a certain resistance is produced. When the user closes the door with a small force, the engaging block 4 is pressed by the supporting plate 21 to retract upwards into the mask body 3 from the second hole 31, and then the spring 5 is pressed to retract upwards. At this time, the spring 5 is acted on by a greater pressure. When the door is closed to a certain degree, the position of the first hole 21 of the supporting plate 2 is just corresponding to the position of the engaging block 4. At this time, under the action of the spring force of the spring 3 and the gravity of the engaging block 4, the engaging block 4 is extended out quickly to fit with the first hole 21 of the supporting plate 2. Thus, the door 200 is locked, and the door closure stopping of the door 200 is ensured.

The process of opening the door 200 is just opposite to the process of closing the door 200. The user pulls the engaging block 4 from the first hole 21 of the supporting plate 2 with a small force, and continues rotating the door 200. At this time, the engaging block 4 is pressed by the supporting plate 21 to retract upwards into the mask body 3 from the second hole 31, and then the spring 5 is pressed to retract upwards. At this time, the spring 5 is acted on by a greater pressure. When the door 200 is opened to a certain degree, the supporting plate 2 is drawn out of the receiving space defined by the recess 210 and the cover plate 33, and then the engaging block 4 is pushed by the spring 5 to move downwards to make a part of the engaging block 4 exposed out of the mask body 3 from the second hole 31 of the cover plate 33. Thus, the process of opening the door 200 is completed.

It should be understood that, the door closure structure according to embodiments of the present disclosure may also be used in other types of doors or cabinet doors.

According to an embodiment of the present disclosure, a side-by-side refrigerator is also provided. The side-by-side refrigerator comprises two door closure structures 100 described above, a main body, a left door, and a right door. The front surface of the main body is open and the hinge bodies 11 of the two door closures structures are disposed on a left side and a right side of a front edge of the main body respectively. The left door and the right door are rototably mounted on the front surface of the main body via the hinge assembly 1, and the mask bodies 3 are mounted on horizontal end surfaces of the left door and the right door respectively.

Alternatively, the mask bodies 3 are mounted on the upper end surfaces of the left door and the right door respectively, i.e., the recesses 210 are formed in the upper end surfaces of the left door and the right door respectively.

Other components of the side-by-side refrigerator according to embodiments of the present disclosure, such as an overturn beam in the center of the refrigerating chamber, a refrigerating control system, a freezing control system and a refrigerating system, and the operation thereof are known to those skilled in the art and are not described in detail herein.

With the side-by-side refrigerator according to embodiments of the present disclosure, by using the above door closure structures, a better door closure stopping effect is obtained, and one door is not opened due to the pressure caused when the other door is closed with a large force, which prevents the refrigerator from leaking cold and reduces a condensation power consumption.

Reference throughout this specification to "an embodiment", "some embodiments", "one embodiment", "an example", "a specific examples", or "some examples" means that a particular feature, structure, material, or characteristic described in connection with the embodiment or example is included in at least one embodiment or example of the disclosure. Thus, the appearances of the phrases such as "in some embodiments", "in one embodiment", "in an embodiment", "an example", "a specific examples", or "some examples" in various places throughout this specification are not necessarily referring to the same embodiment or example of the disclosure. Furthermore, the particular features, structures, materials, or characteristics may be combined in any suitable manner in one or more embodiments or examples.

Although explanatory embodiments have been shown and described, it would be appreciated by those skilled in the art that changes, alternatives, and modifications may be made in the embodiments without departing from spirit and principles of the disclosure. Such changes, alternatives, and modifications all fall into the scope of the claims and their equivalents.

What is claimed is:

1. A door closure structure for a rotary door rotatably mounted on a main body, comprising:

a hinge assembly, wherein the rotary door is mounted on the main body via the hinge assembly, and the hinge assembly comprises:

a hinge body fixed on the main body, the hinge body including a front end;

a hinge plate provided with a hinge hole and connected with a rear end of the hinge body; and a hinge shaft fitted with the hinge hole;

a supporting plate, provided with a first hole at a first end and connected with the front end of the hinge body at a second end;

a mask body fixed on the rotary door at a mounting point, wherein a mask cavity is defined in the mask body and a second hole is disposed in a surface of the mask body, a first surface of the mask body being open; and an engaging block retractably and movably disposed in the mask cavity, wherein a part of the engaging block is exposable out of the mask body from the second hole and the part of the engaging block extended out of the mask body is engagable with the first hole;

a cover plate disposed on the first surface of the mask body to close the first surface, in which the second hole is formed in the cover plate, the cover plate being spaced apart from the mounting point of the mask body;

an elastic member disposed between the mask body and the cover plate, the cover plate applying a preload to the elastic member; and a groove communicated with the first surface is formed in a second surface of the mask body adjacent to the first surface of the mask body;

wherein in a closed state of the rotary door, the supporting plate is inserted into the groove, and the engaging block engages with the first hole to maintain closure of the rotary door relative to the main body.

2. The door closure structure according to claim 1, wherein a hollow column with a cylindrical hole defined therein is disposed in the mask cavity and is extended towards the first surface of the mask body from an inner wall of the mask cavity opposite to the first surface of the mask body; and wherein the elastic member is abutted between the hollow column and the engaging block after being pre-compressed.

3. The door closure structure according to claim 1, wherein the first surface of the mask body is a lower surface of the mask body and the second surface of the mask body is a left surface of the mask body.

4. The door closure structure according to claim 1, wherein the engaging block is spherical.

5. The door closure structure according to claim 1, wherein the engaging block is polyhedral.

6. The door closure structure according to claim 4, wherein the first hole and the second hole are round holes.

7. The door closure structure according to claim 2, wherein the elastic member is a spring or a bellow.

8. The door closure structure according to claim 5, wherein the first hole and the second hole are round holes.

9. A side-by-side refrigerator, comprising:

two door closure structures, wherein each door closure structure comprises:

a hinge assembly comprising:

a hinge body;

a hinge plate provided with a hinge hole and connected with a rear end of the hinge body; and a hinge shaft fitted with the hinge hole;

a supporting plate, provided with a first hole at a first end and connected with the front end of the hinge body at a second end;

a mask body, in which a mask cavity is defined in the mask body and a second hole is disposed in a surface of the mask body, a first surface of the mask body being open; and an engaging block retractably and movably disposed in the mask cavity;

a main body with an open front surface, wherein the hinge bodies of the two door closure structures are fixed on the main body, the hinge body including a front end and disposed on a left side and a right side of a front edge of the main body respectively; and a left door and a right door rotatably mounted on the front surface of the main body, wherein the mask bodies of the two door closure structures are fixed on the left door and the right door and mounted at mounting points on horizontal end surfaces of the left door and the right door respectively, the left door and the right door are mounted on the main body via the hinge assemblies, a part of the engaging block is exposable out of the mask body from the second hole, and the part of the engaging block extended out of the mask body is engagable with the first hole;

wherein each door closure structure further comprises:

a cover plate disposed on the first surface of the mask body to close the first surface, in which the second hole is formed in the cover plate, the cover plate being spaced apart from the mounting point of the mask body on the horizontal end surface on the main body;

an elastic member disposed between the mask body and the cover plate, the cover plate applying a preload to the elastic member; and a groove communicated with the first surface is formed in a second surface of the mask body adjacent to the first surface of the mask body;

wherein in a closed state of the left door and the right door, each of the supporting plates are inserted into the grooves, and each of the engaging blocks engage with the first holes to maintain closure of the left door and the right door relative to the main body.

10. The side-by-side refrigerator according to claim 9, wherein the mask bodies are mounted on upper end surfaces of the left door and the right door respectively.

11. The side-by-side refrigerator according to claim 9, wherein a hollow column with a cylindrical hole defined therein is disposed in the mask cavity and is extended towards the first surface of the mask body from an inner wall of the mask cavity opposite to the first surface of the mask body; and wherein the elastic member is abutted between the hollow column and the engaging block after being pre-compressed.

12. The side-by-side refrigerator according to claim 9, wherein the first surface of the mask body is a lower surface of the mask body and the second surface of the mask body is a left surface of the mask body.

13. The side-by-side refrigerator according to claim 9, wherein the engaging block is spherical.

14. The side-by-side refrigerator according to claim 9, wherein the engaging block is polyhedral.

15. The side-by-side refrigerator according to claim 13, wherein the first hole and the second hole are round holes.

16. The side-by-side refrigerator according to claim 14, wherein the first hole and the second hole are round holes.

17. The side-by-side refrigerator according to claim 11, wherein the elastic member is a spring or a bellow.

* * * * *